US011002447B2

(12) United States Patent
Roden

(10) Patent No.: US 11,002,447 B2
(45) Date of Patent: May 11, 2021

(54) ELECTRIC STARTER

(71) Applicant: TYL, Inc., Fort Worth, TX (US)

(72) Inventor: Tripp Roden, Keller, TX (US)

(73) Assignee: TYL, Inc., Forth Worth, TX (US)

( * ) Notice: Subject to any disclaimer, the term of this patent is extended or adjusted under 35 U.S.C. 154(b) by 652 days.

(21) Appl. No.: 15/165,843

(22) Filed: May 26, 2016

(65) Prior Publication Data

US 2016/0348910 A1 Dec. 1, 2016

Related U.S. Application Data

(60) Provisional application No. 62/167,080, filed on May 27, 2015.

(51) Int. Cl.
*F23Q 7/02* (2006.01)
*H05B 3/42* (2006.01)

(52) U.S. Cl.
CPC ..... *F23Q 7/02* (2013.01); *H05B 3/42* (2013.01)

(58) Field of Classification Search
CPC ..... F23Q 7/00; F23Q 7/02; F23Q 7/14; F23Q 7/06; F23Q 7/10; F23Q 7/08
USPC ..... 219/270, 260, 267, 261, 262, 268, 269
See application file for complete search history.

(56) References Cited

U.S. PATENT DOCUMENTS 2,841,683 A * 7/1958 Ogle ..... A47J 37/079 126/25 B
2,905,453 A * 9/1959 Wise ..... A47J 43/1068 416/176
2,938,988 A * 5/1960 McCutcheon ..... F23Q 7/02 126/25 B
3,073,263 A * 1/1963 Wynkoop ..... A47J 37/079 126/163 R
3,339,505 A * 9/1967 Bean ..... F24B 15/005 126/25 B
3,529,557 A * 9/1970 Treanor ..... A47J 37/079 126/25 B
3,628,474 A * 12/1971 Rehwaldt ..... F23Q 7/02 126/25 B
4,321,907 A * 3/1982 Sutter ..... A47J 37/079 126/25 B
4,406,941 A * 9/1983 Schmerein, Jr. ..... F23Q 7/02 219/261
4,499,369 A * 2/1985 Gibb ..... H05B 3/64 219/270
4,901,196 A 2/1990 Grzybowski
5,135,388 A 8/1992 Pettit
5,197,455 A * 3/1993 Tessien ..... A47J 37/079 126/144
D346,530 S 5/1994 Elliot et al.
(Continued)

OTHER PUBLICATIONS

"Electric Charcoal Lighter," Big Green Egg—The Ultimate Cooking Experience, posted Aug. 28, 2011, <http://www.biggreenegg.com/eggcessories>.

(Continued)

*Primary Examiner* — Robert J Utama
*Assistant Examiner* — Ayub A Maye
(74) *Attorney, Agent, or Firm* — Sterne, Kessler, Goldstein & Fox P.L.L.C.

(57) ABSTRACT

An electric starter is disclosed, for lighting solid fuel such as charcoal or wood. The lighter includes a handle and a heating element coupled to the handle. The heating element may include multiple ignition layers vertically spaced apart.

19 Claims, 12 Drawing Sheets

(56) References Cited

U.S. PATENT DOCUMENTS

| | | | | |
|---|---|---|---|---|
| 5,469,835 | A * | 11/1995 | Stephen | A47J 37/079 126/146 |
| 6,929,466 | B1 | 8/2005 | Reese | |
| 7,717,104 | B2 * | 5/2010 | Looft | F23Q 7/04 126/25 B |
| 8,851,885 | B2 | 10/2014 | Wiles et al. | |

OTHER PUBLICATIONS

"Grill Dome Rapid-Lite Electric Charcoal Lighter," BBQ Guys, accessed Mar. 16, 2015, <http://www.bbqguys.com/>.
"Electric Charcoal Starter," BBQ Guys, accessed Mar. 16, 2015, <http://bbqguys.com/>.
"Bull Electric Charcoal Starter," BBQ Guys, accessed Mar. 16, 2015, <http://bbqguys.com/>.

* cited by examiner

ELECTRIC STARTER

CROSS-REFERENCE TO RELATED APPLICATION(S)

This application claims priority to U.S. Provisional Application No. 62/167,080, filed on May 27, 2015, which is incorporated herein in its entirety by reference thereto.

FIELD

The described embodiments relate generally to charcoal starters.

BACKGROUND

Burning charcoal or wood is known to be used for cooking, and is typically ignited before such use.

SUMMARY

Some embodiments of the present invention include an electric charcoal starter including a handle and a heating element coupled to the handle, where the heating element includes a plurality of ignition layers vertically spaced apart. In some embodiments the ignition layers define loops. In some embodiments they are electrically connected in series. In some embodiments the heating element is continuous from the handle, through the ignition layers, and back to the handle. In some embodiments the ignition layers are spaced apart by at least two, or at least four, inches. In some embodiments the starter includes no more or less than two ignition layers. In some embodiments the starter includes no more or less than three ignition layers. In some embodiments, the heating element is metal that will heat above 650 degrees Celsius (e.g., up to 700 degrees Celsius) when connected to mains electricity (e.g., a 120-volt power source at 50/60 hertz).

Some embodiments of the present invention include an electric charcoal starter including a handle, an ignition element, and a lead electrically connecting the handle and the ignition element, where the ignition element comprises at least two vertically-spaced ignition loops. In some embodiments the ignition loops are concentric. In some embodiments they are circular. In some embodiments a lower ignition loop has a smaller loop diameter than an upper ignition loop. In some embodiments the lead is insulated so that it maintains a lower surface temperature than the ignition element when current is passed through the ignition element.

Some embodiments of the present invention include an electric charcoal starter including a handle, a heating element having a first end and a second end. Each of the first end and the second end may be connected to the handle. The heating element may extend from the first end out from the handle until a first ignition loop, bend at the first ignition loop to form the first ignition loop (wherein the plane of the first ignition loop forms a first angle of between 45 degrees and 135 degrees with respect to a first straight portion of the heating element most closely connected to the ignition loop), extend from the first ignition loop parallel to the first straight portion until a second ignition loop, bend at the second ignition loop to form the second ignition loop (wherein the plane of the second ignition loop forms an angle of between 45 degrees and 135 degrees with respect to the first straight portion of the heating element), and extend from the second ignition loop to the handle.

In some embodiments portions of the ignition element between the second ignition loop and the handle extend in parallel. In some embodiments the ignition loops are circular. In some embodiments they are rectangular. In some embodiments the first angle and the second angle differ by less than 5 degrees. In some embodiments the first ignition loop is below the second ignition loop. In some embodiments each of the two ends is connected to a power cord with a plug for accepting electrical current. In some embodiments the heating element is insulated between the second ignition loop and the handle.

DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
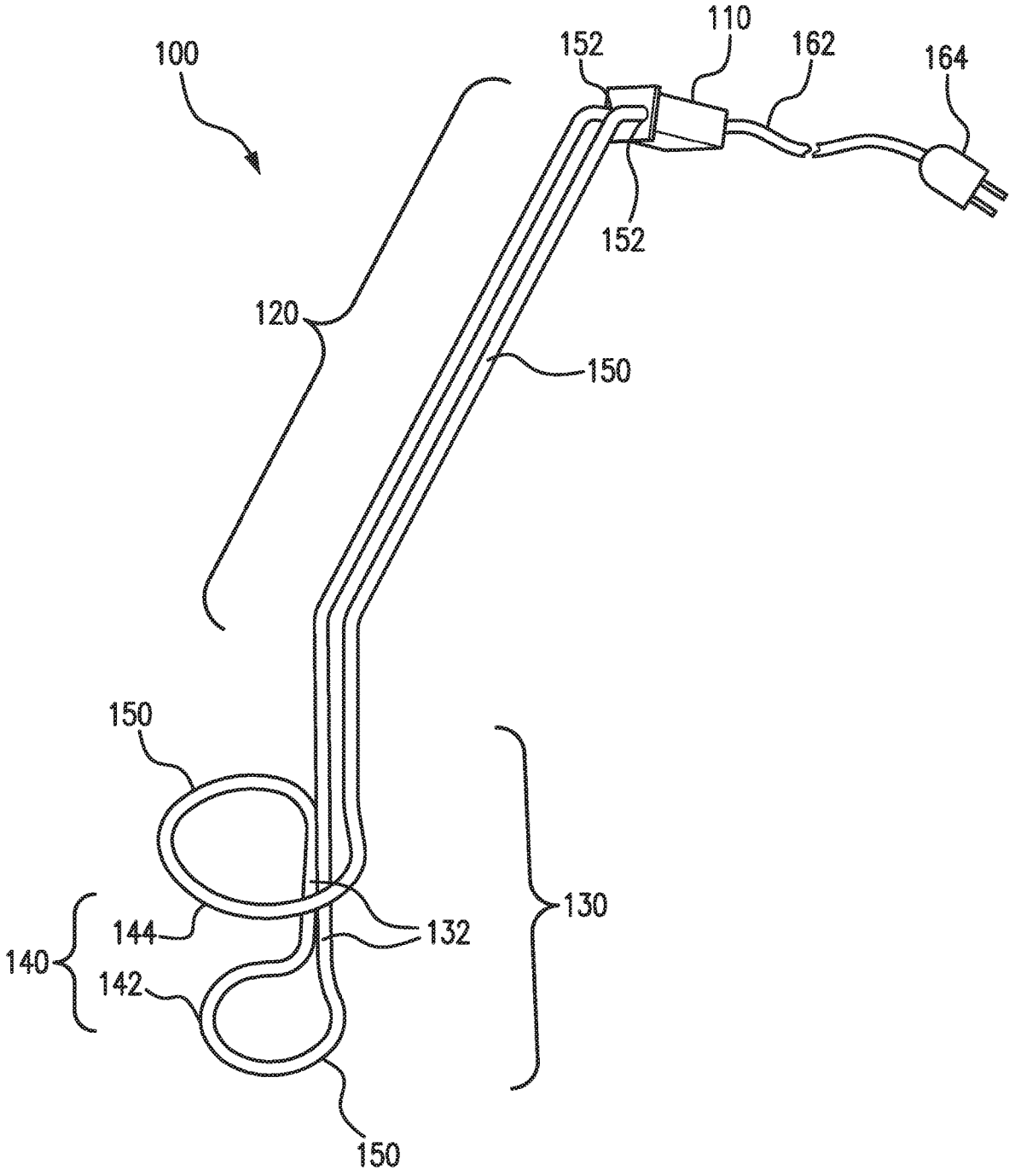
FIG. 1 shows a perspective view of an electric charcoal starter according to some embodiments.

Reference will now be made in detail to representative embodiments illustrated in the accompanying drawings. It should be understood that the following description is not intended to limit the embodiments to one preferred embodiment. To the contrary, it is intended to cover alternatives, modifications, and equivalents as can be included within the spirit and scope of the described embodiments as defined by the claims.

This disclosure relates to an electric starter, for lighting solid combustible fuel such as charcoal or wood. Charcoal is a fuel often used for cooking food, especially "grilling"-style cooking. Charcoal must be ignited in order to burn, and to thereby produce the heat used for cooking. Charcoal is often sold in "briquette" form, but the charcoal discussed herein may be any form of charcoal. Further, "charcoal" as used herein may be replaced with other cooking fuels that benefit from ignition, such as, for example, wood or coal.

Since charcoal requires ignition to burn, charcoal starters (also called "igniters" or "lighters") that ignite the charcoal have been developed. For example, sources of flame may be applied to the charcoal (e.g., matches, cigarette lighters, etc.) or to crumpled newsprint in contact with the charcoal. Also for example, electric heating elements may be put in contact with the charcoal. These techniques may rely on the contact of the ignited charcoal with other charcoal in a pile to spread the ignition throughout the rest of the pile of charcoal.

Other methods may light the charcoal in a container separate from its cooking location (e.g., a canister-style "chimney" starter) or may use an accelerant to spread ignition (e.g., a petroleum- or alcohol-based lighter fluid). Lighting it in a separate container requires inconvenient transferring of the ignited charcoal from the chimney to the cooking location. An accelerant may be costly and may give off undesirable odors or flavors.

Thus, to light charcoal in its cooking location without accelerant, prior methods and devices for igniting charcoal rely on igniting an isolated area of charcoal, and waiting for the charcoal itself to spread the ignition to other areas.

Some embodiments of the present invention provide an electric charcoal starter that simultaneously ignites multiple areas of a pile of charcoal, thereby achieving ignition of the entire pile faster and with fewer devices or operations than could be achieved previously. For example, a starter according to some embodiments may include a multi-layer ignition element that reaches a surface temperature sufficient to catalyze combustion of charcoal within 5-10 minutes of being energized. By emitting such high heat simultaneously in vertically-spaced layers, the ignition element can promote fast ignition of a full charcoal pile (e.g., 2 to 5 pounds of charcoal) in under 7 minutes.

These and other embodiments are discussed below with reference to the figures. Those skilled in the art will readily appreciate that the detailed description given herein with respect to these figures is for explanatory purposes only and should not be construed as limiting.

FIG. 1 illustrates a perspective view of an electric charcoal starter 100 according to some embodiments of the invention. FIG. 2 shows starter 100 from the side. Starter 100 may include a handle 110 and an ignition element 130, with a lead 120 connecting therebetween. Ignition element 130 and lead 120 may be formed from the same heating element 150 (e.g., a continuous heating element 150). Starter 100 may also include a power cable 162, which may be attached to and extend from handle 110. In some embodiments the end of power cable 162 connected to handle 110 may be also connected to heating element 150 within handle 110. Handle 110 may be thermally insulated for comfort in holding starter 100, and its internal electrical connections may be potted therein. The other end of power cable 162 may terminate in a plug 164 suitable for plugging into a standard wall power source (e.g., power source 170, see FIG. 4) or extension cord to provide power to starter 100. In some embodiments handle 110 is formed of a thermally insulating material (e.g., polyoxybenzylmethylenglycolanhydride (e.g., Bakelite®) or a polycarbonate that remains stable when subjected to ultraviolet light and flame) and forms a hand grip for holding starter 100. The thermally insulating material of handle 110 can resist the high temperatures of the ignition element sufficiently that handle 110 will not reach a temperature capable of causing discomfort to a user holding handle 110 with a bare hand. For example, in some embodiments the insulation resistance is more than 10 megaohms (MΩ).

In some embodiments power source 170 may be standard mains power supply (e.g., alternating current at 120 or 230 volts (e.g., at 50/60 hertz)). In some embodiments power source 170 may be an electrical generator (e.g., a combustion-powered generator). In some embodiments power source 170 may be a battery (e.g., a direct-current battery incorporated into or mounted on starter 100 or separate therefrom and connected by power cable 162). In some embodiments power source 170 may be a photovoltaic ("solar") panel (e.g., incorporated into or mounted on starter 100 or separate therefrom and connected by power cable 162). In some embodiments plug 164 may be omitted, and starter 100 may be wired directly to power source 170. In some embodiments plug 164 and power cable 162 may be omitted, and starter 100 may include power source 170 (e.g., in handle 110 or in another integrated power source 170 such as an attached battery pack or solar panel).

Figure 5:
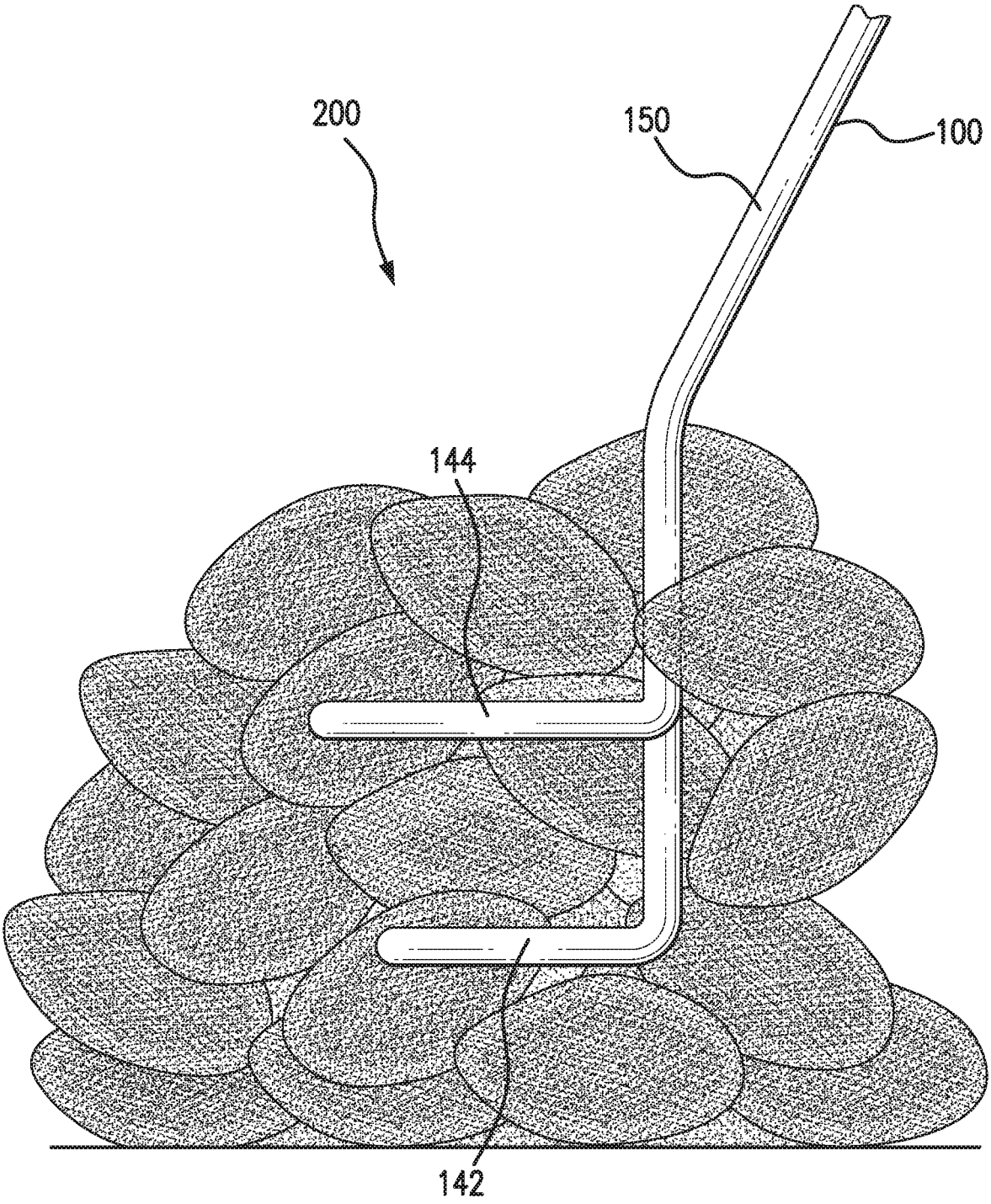
FIG. 5 shows an electric charcoal starter and charcoal according to some embodiments.

In use, a user may place ignition element 130 into a pile of charcoal (or may form the pile around ignition element 130) in, for example, a grill basin. For example, FIG. 5 shows a representation of starter 100 in a pile 200 of charcoal.

In some embodiments, heating element 150 is formed of metal that will heat above 650 degrees Celsius (e.g., up to 700 degrees Celsius) when connected to mains electricity (e.g., 120 volts, 230 volts (at e.g., 50/60 hertz)), and may have current leakage of less than 0.5 milliamps. Charcoal generally will ignite at this temperature. For example, heating element 150 may be formed of a heating tube, which may be metal (e.g., steel, such as copperplating steel or stainless steel). In some embodiments, the heating tube may be able to withstand a voltage of 1500 volts for 1 minute, with a leakage current of less than 20 milliamps. When energized with electric current, ignition element 130 may convert electric energy to heat energy (e.g., by resistive properties of ignition element 130), and may emit such heat energy. This emission may heat material that is in contact with ignition element 130, by transferring heat to it. Ignition element 130 may emit sufficient heat to ignite ("light" or "start") charcoal with which it is in contact. For example, ignition element may reach a surface temperature of at least 350 degrees Celsius (e.g., 650 degrees Celsius or up to 700 degrees Celsius). In some embodiments, ignition element 130 may reach a surface temperature above 650 degrees Celsius (e.g., up to 1100 degrees Celsius) within 5-10 minutes of being energized by mains electricity. For example, in some embodiments ignition element 130 may reach a surface temperature of between 1000 degrees Celsius and 1100 degrees Celsius. Ignition element 130 may maintain its surface temperature (e.g., above 650 degrees Celsius, such as between 1000 degrees Celsius and 1100 degrees Celsius) while energized by mains electricity (e.g., 120 volts, 230 volts (at e.g., 50/60 hertz)). By emitting such high heat simultaneously in vertically-spaced areas, ignition element 130 can promote ignition of a full charcoal pile 200 (e.g., 2 to 5 pounds of charcoal) in under 7 minutes after being heated and applied to the charcoal. To achieve such properties, in some embodiments ignition element 130 may be formed of a material having an electrical resistance sufficient to provide a power utilization of 600 watts when connected to mains electricity (e.g., 120 volts at 50/60 hertz).

Figure 6:
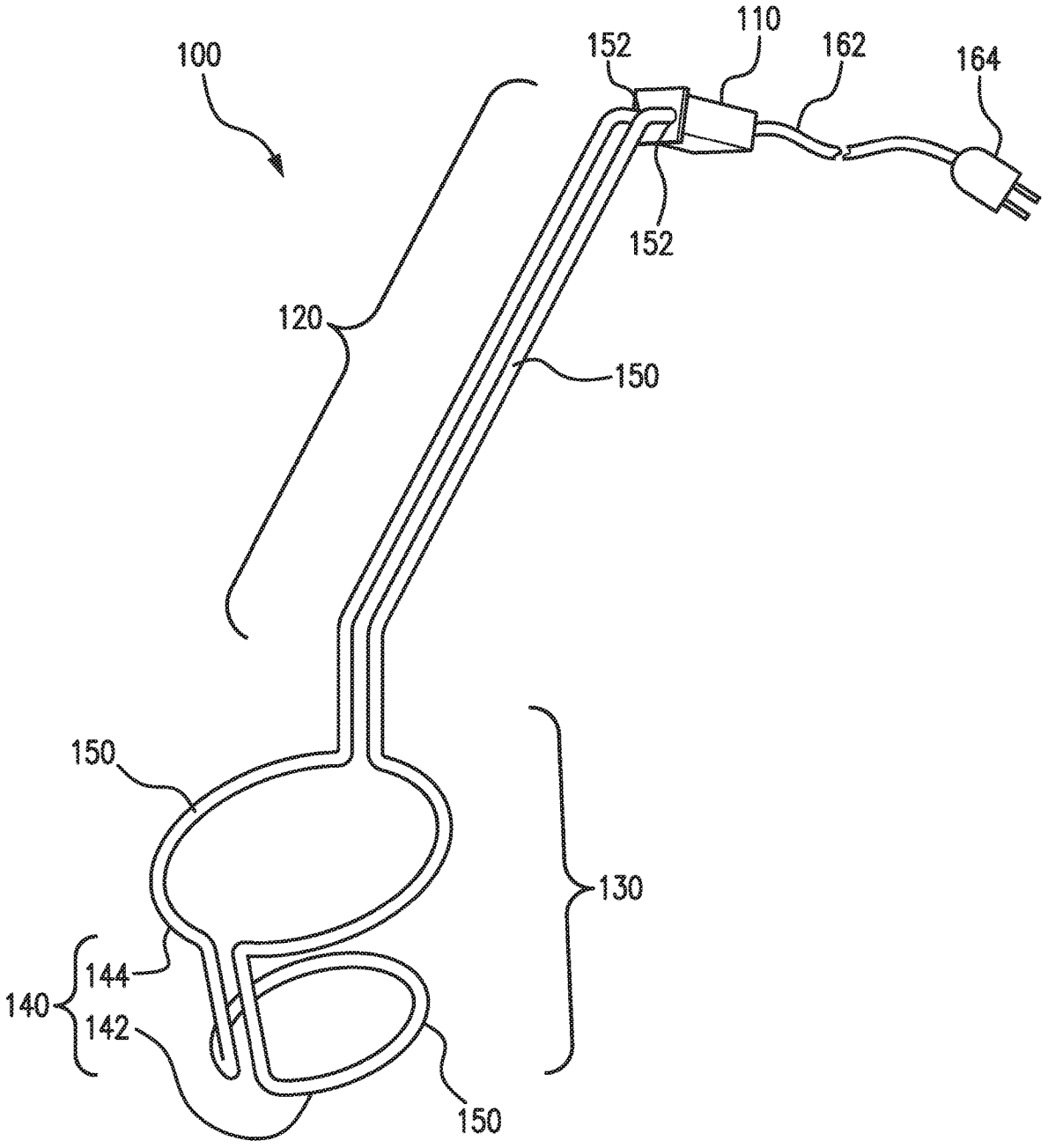
FIG. 6 shows a perspective view of an electric charcoal starter according to some embodiments.
Figure 8:
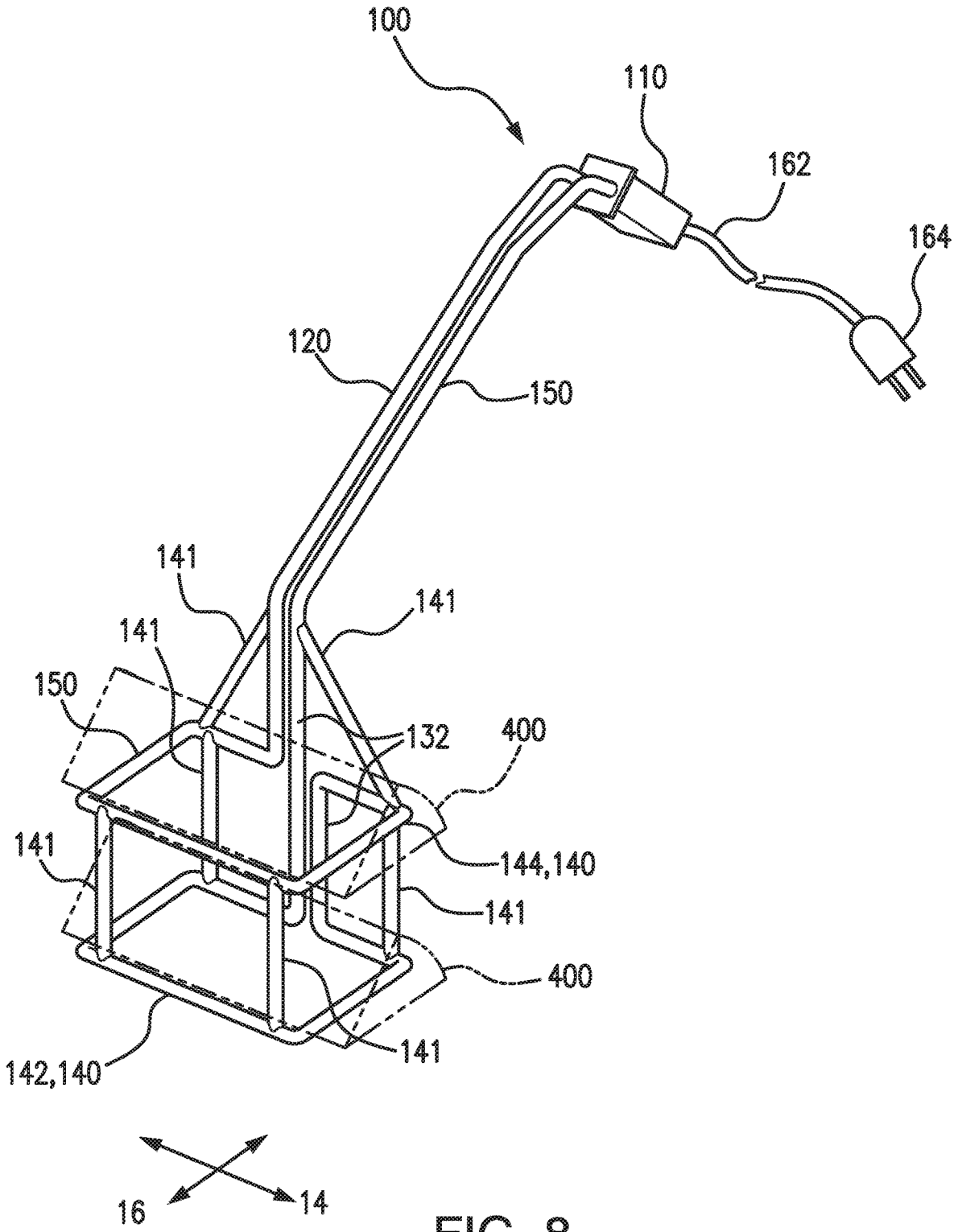
FIG. 8 shows a perspective view of an electric starter and logs.

In some embodiments heating element 150 may be formed into a shape such that it is continuous from handle 110, through ignition layers 140, and back to handle 110, as shown, for example, in FIGS. 1, 6, and 8. In this way, ignition layers 140 may be electrically connected in series.

In some embodiments ignition element 130 and lead element 120 have the same resistive properties (e.g., because they may be formed from the same continuous heating element 150). In some embodiments ignition element 130 may have higher resistive properties than lead element 120, so that ignition element 130 emits more heat than lead element 120. In some embodiments lead element 120 is thermally insulated so as not to emit as much heat as ignition element 130. For example, all or portions of lead element 120 may be coated with a thermally insulative material such as, for example, polyoxybenzylmethylenglycolanhydride. In some embodiments portions of ignition element 130 may have higher resistive properties than other portions of ignition element 130, so that the higher-resistance portions of ignition element 130 emit more heat than the lower-resistance portions. In some embodiments portions of ignition element 130 may be thermally insulated so as not to emit as much heat as other portions of ignition element 130. For example, in some embodiments non-ignition-layer 140 portions of ignition element 130 may be coated with a thermally-insulative material such as, for example, polyoxybenzylmethylenglycolanhydride (alternatively or additionally, lead element 120 may be coated with the same or a different thermally-insulative material). Such a configuration may concentrate heat emission to ignition layers 140, by insulating other portions of heating element 150 (or by forming such other portions to have a lower electrical resistance, to thereby emit less heat). For example, in some embodiments the insulation resistance of insulated portions of electric charcoal starter 100 is more than 10 megaohms (MΩ).

Figure 2A:
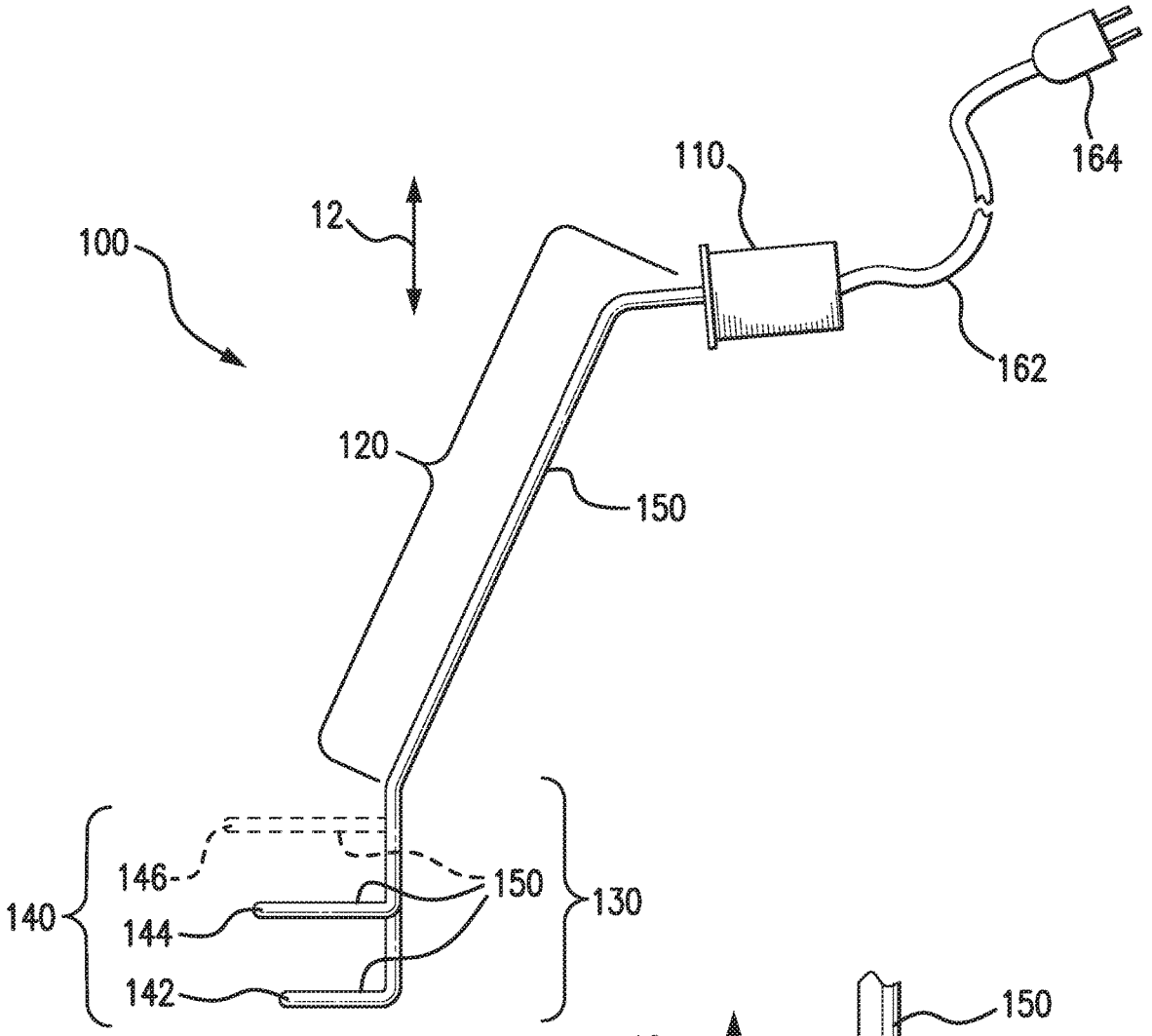
FIG. 2A shows a side view of an electric charcoal starter according to some embodiments.
Figure 2B:
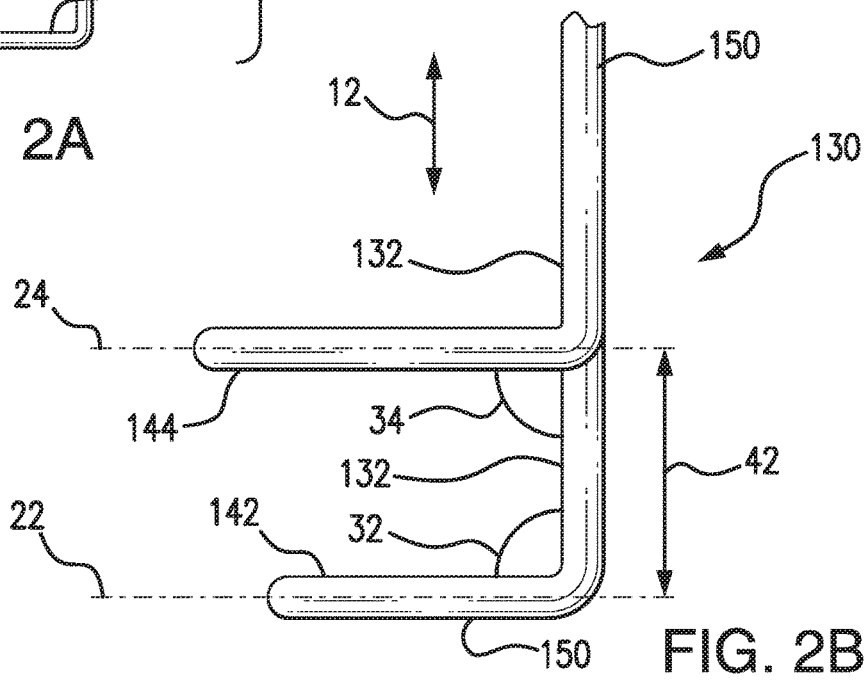
FIG. 2B shows an enlarged side view of an electric charcoal starter according to some embodiments.
Figure 3A:
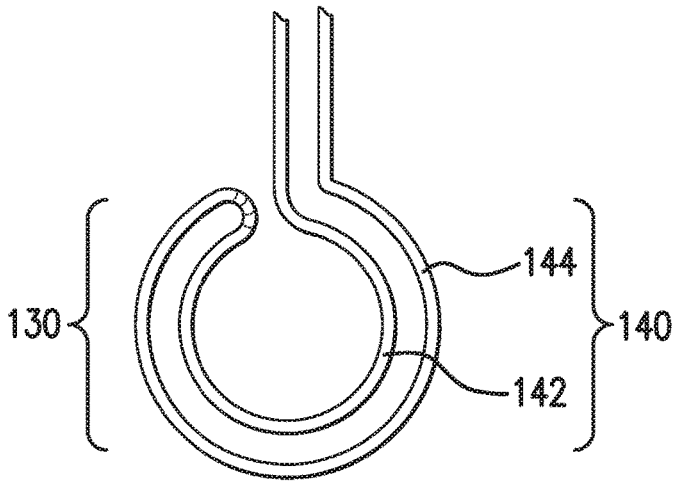
FIG. 3A shows a top view of a portion of an electric charcoal starter according to some embodiments.
Figure 3B:
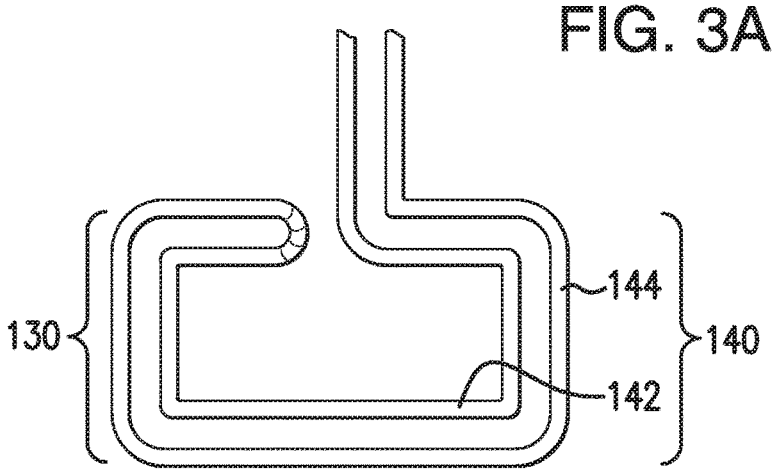
FIG. 3B shows a top view of a portion of an electric charcoal starter according to some embodiments.
Figure 3C:
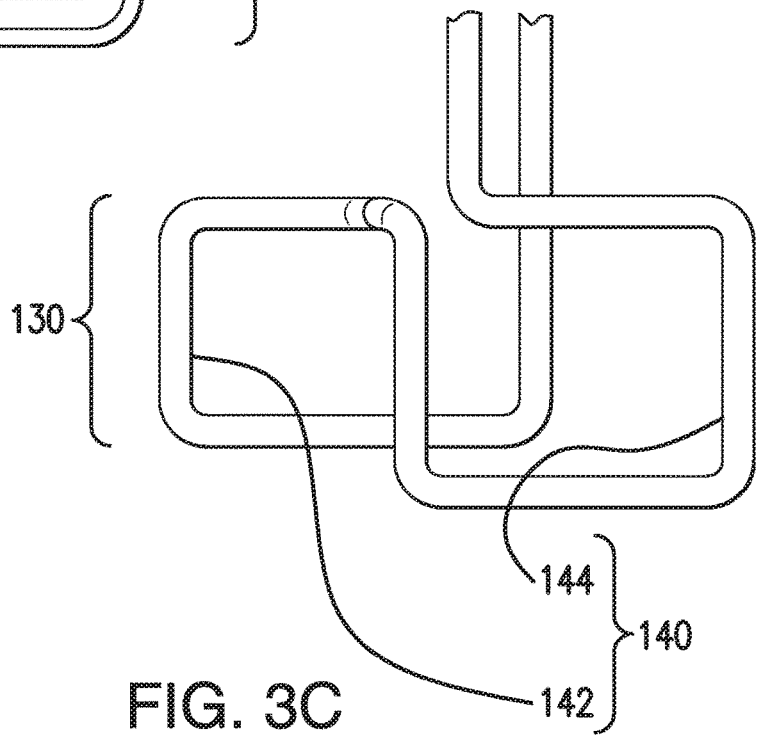
FIG. 3C shows a top view of a portion of an electric charcoal starter according to some embodiments.
Figure 4:
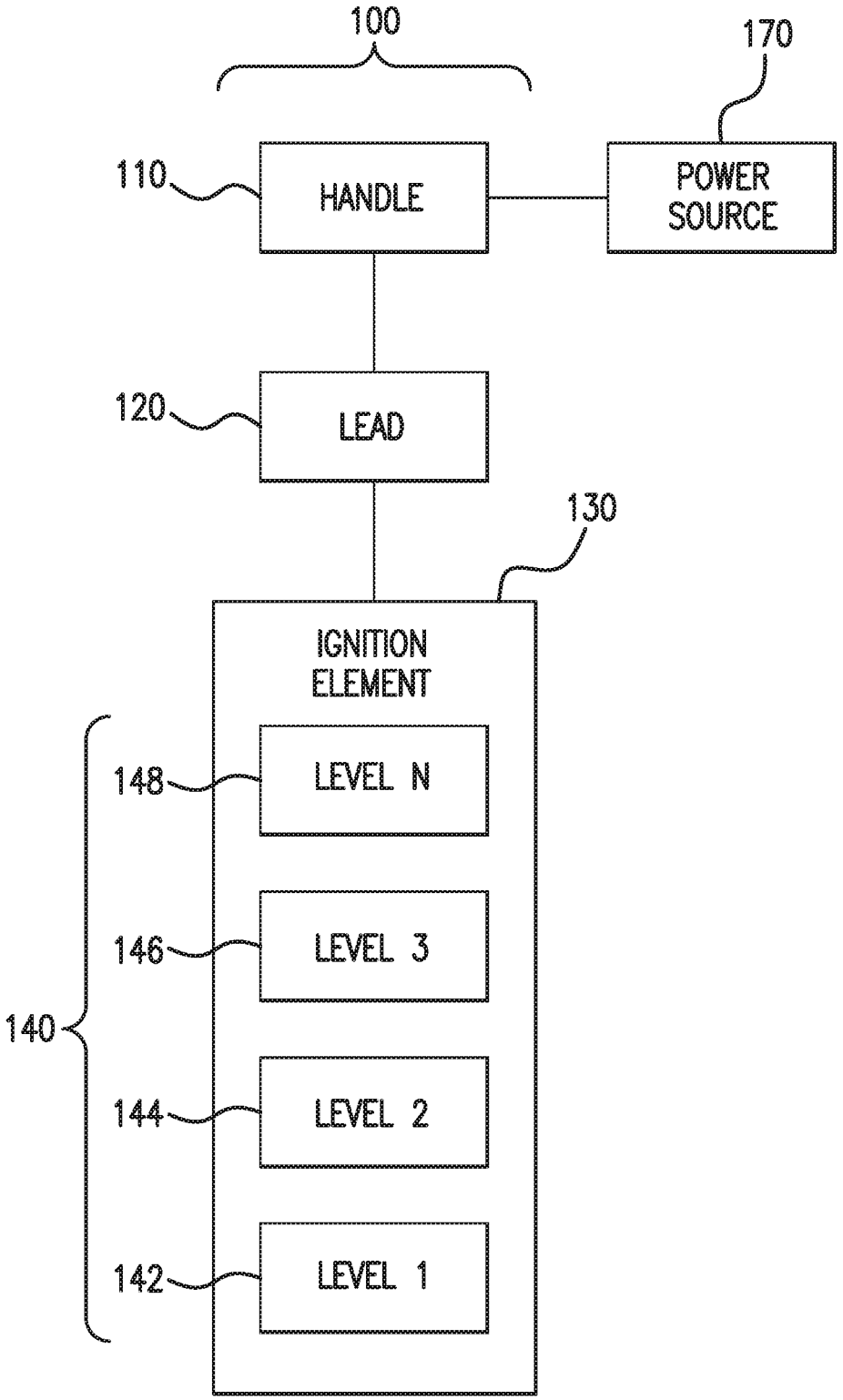
FIG. 4 shows a diagram of an electric charcoal starter according to some embodiments.

Ignition element 130 may include multiple ignition layers 140, such as ignition layer 142 and ignition layer 144 as shown throughout the figures (e.g., FIGS. 1, 2A, 2B). Ignition element 130 may include any suitable number of ignition layers 140, including, for example, ignition layers 142, 144, and 146. As shown in FIG. 4, in some embodiments ignition element 130 includes additional ignition layers 148. In some embodiments ignition element 130 includes only two ignition layers 140. In some embodiments ignition element 130 includes only three ignition layers 140. In some embodiments ignition layers 140 are spaced apart vertically, along a shaft portion 132 of ignition element 130. (In FIGS. 2A and 2B, arrows 12 represent the vertical direction.) For example, ignition layers 140 may be spaced apart by a distance 42. In some embodiments distance 42 is four inches. In some embodiments distance 42 is between two and six inches. In some embodiments distance 42 is between 1.5 and 2.5 inches. In some embodiments distance 42 is at least 1.5 inches. In some embodiments distance 42 is two inches. In some embodiments distance 42 is at least four inches.

Since ignition element 130 includes multiple ignition layers 140, it can emit heat in multiple layers, thereby more quickly transferring heat to charcoal or another fuel source. For example, as shown in FIG. 5, electric charcoal starter 100 may be placed so that its ignition element 130 is in a pile 200 of charcoal. With ignition layers 140 in contact with charcoal of charcoal pile 200 in multiple vertically-displaced areas, charcoal pile 200 will ignite and spread its flame throughout charcoal pile 200 faster than if charcoal pile 200 were lighted in a single layer, and more conveniently than by lighting charcoal pile 200 in multiple places with multiple devices or operations.

In some embodiments ignition layers 140 protrude from a portion of ignition element 130 (e.g., from shaft portion 132). In some embodiments, ignition layers 140 may be formed in a plane, such as, for example, first ignition layer plane 22 and second ignition layer plane 24 shown in FIG. 2B. In some embodiments ignition layers 140 may be parallel with each other. For example, in some embodiments ignition layers 140 may protrude perpendicularly from shaft portion 132, as shown in FIGS. 2A and 2B (e.g., so that first ignition layer plane 22 and second ignition layer plane 24 are perpendicular with respect to shaft portion 132). In some embodiments ignition layers 140 may protrude from shaft portion 132 forming angles (e.g., angles 32 and 34, see FIG. 2B) between 45 degrees and 135 degrees with shaft portion 132 (e.g., so that first ignition layer plane 22 forms an angle 32 between 45 degrees and 135 degrees and second ignition layer plane 24 forms an angle 34 between 45 degrees and 135 degrees with shaft portion 132). In some embodiments angles 32 and 34 are the same. In some embodiments they are different (e.g., in some embodiments they differ by less than 5 degrees).

Figure 9A:
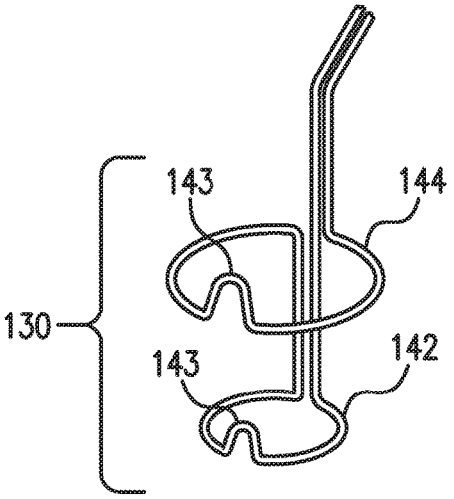
FIG. 9A shows a perspective view of a portion of an electric charcoal starter according to some embodiments.
Figure 9B:
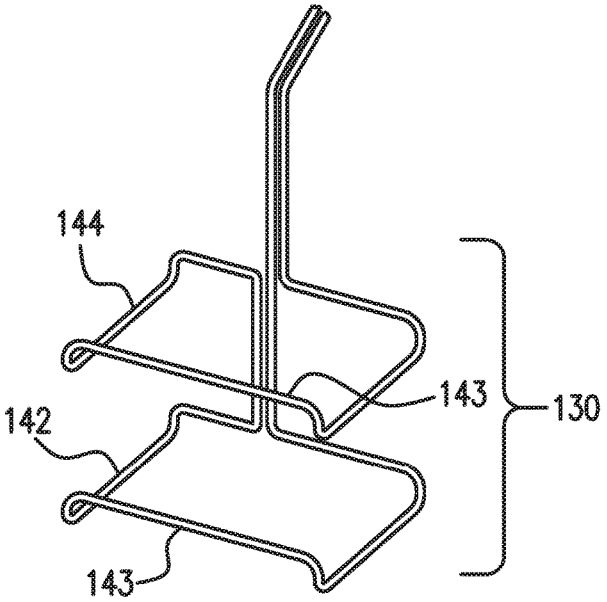
FIG. 9B shows a perspective view of a portion of an electric charcoal starter according to some embodiments.
Figure 9C:
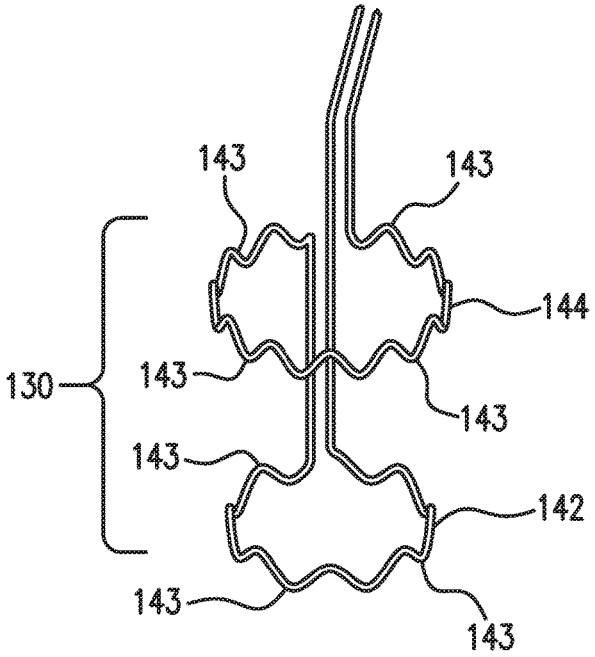
FIG. 9C shows a perspective view of a portion of an electric charcoal starter according to some embodiments.
Figure 9D:
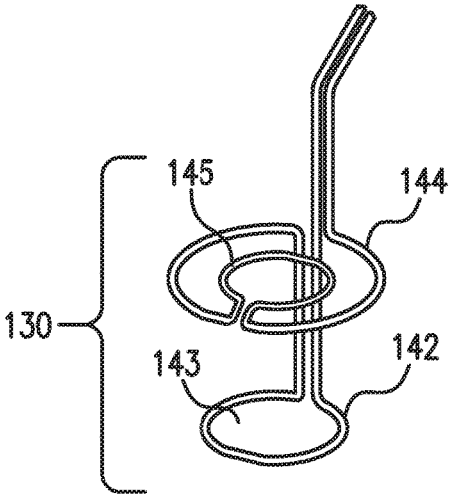
FIG. 9D shows a perspective view of a portion of an electric charcoal starter according to some embodiments.

In some embodiments, ignition layers 140 form loops, as shown, for example, in FIGS. 1, 3A-3C, 6, 11A-11D, and 12A-12D. Such loops may travel along planes (e.g., first ignition layer plane 22 and second ignition layer plane 24). In some embodiments such loops may be non-planar (e.g., as shown in FIGS. 9A and 9B). For example, in some embodiments such non-planar loops may have vertical elements 143 that extend up or down to further facilitate heat emission vertically throughout multiple layers. In some embodiments such non-planar loops may have repeating vertical elements 143, creating a repeating pattern such as, for example, a zig-zag or sinusoidal pattern (see, e.g., FIG. 9C). In some embodiments, loops may be formed within other loops (e.g., a smaller loop 145 as an offshoot of a larger loop 144, e.g., concentrically within the same plane) (see, e.g., FIGS. 9D, 11A-11D, and 12A-12D).

Figure 10:
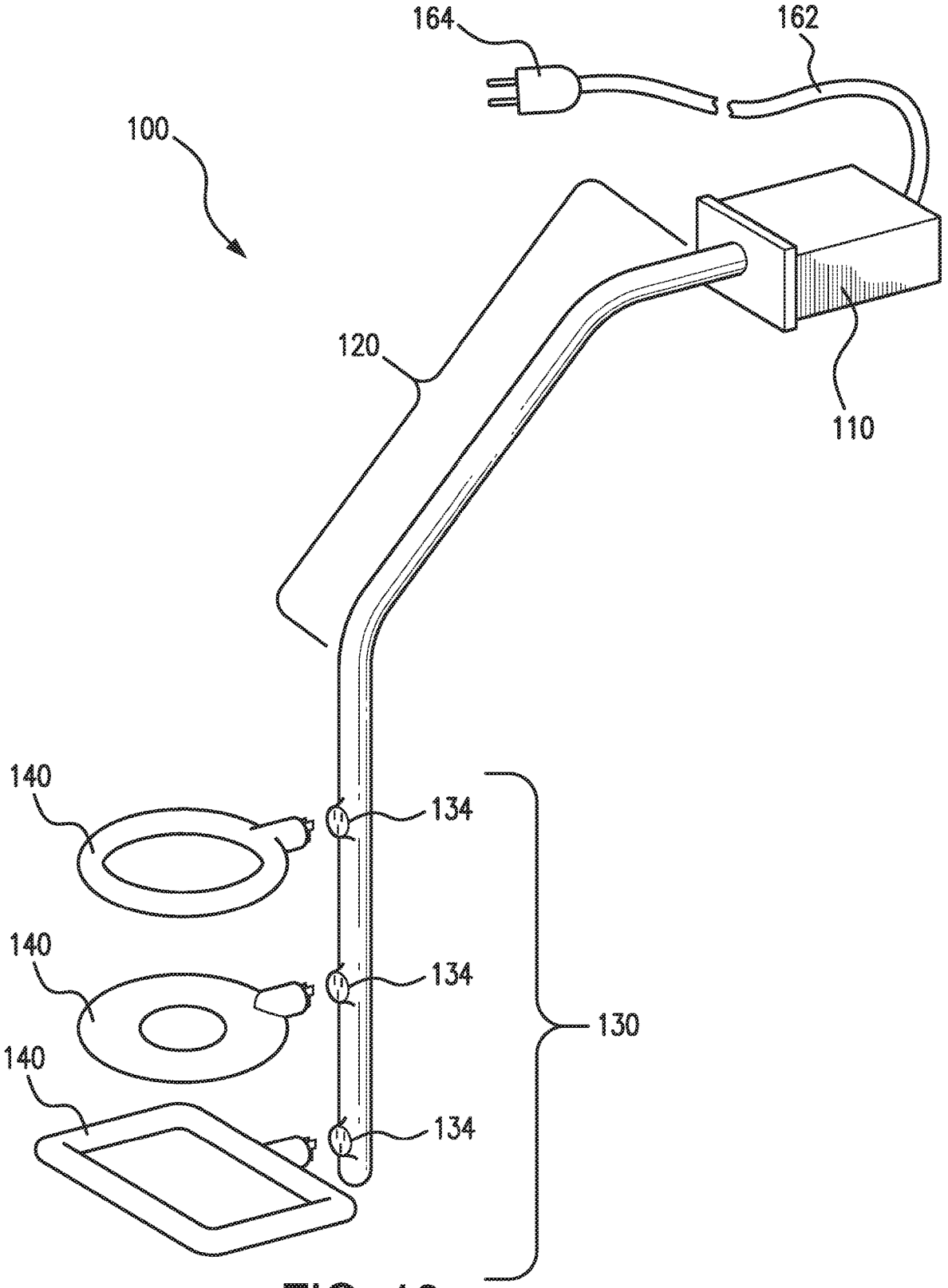
FIG. 10 shows a perspective view of an electric charcoal starter according to some embodiments.
Figures 11A, 11B, 11C, 11D:
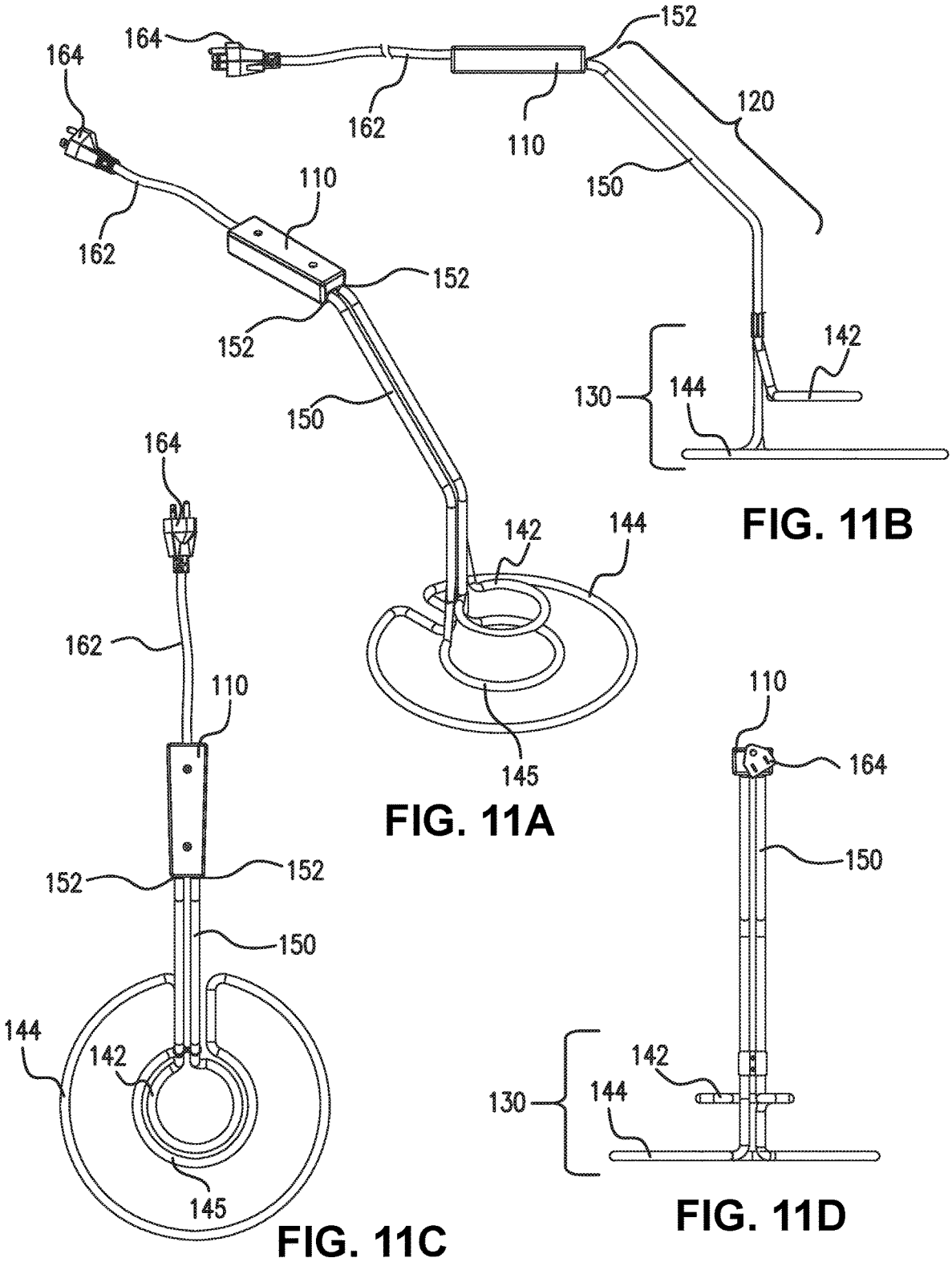
FIGS. 11A-11D show views of an electric charcoal starter according to some embodiments.
Figure 12B:
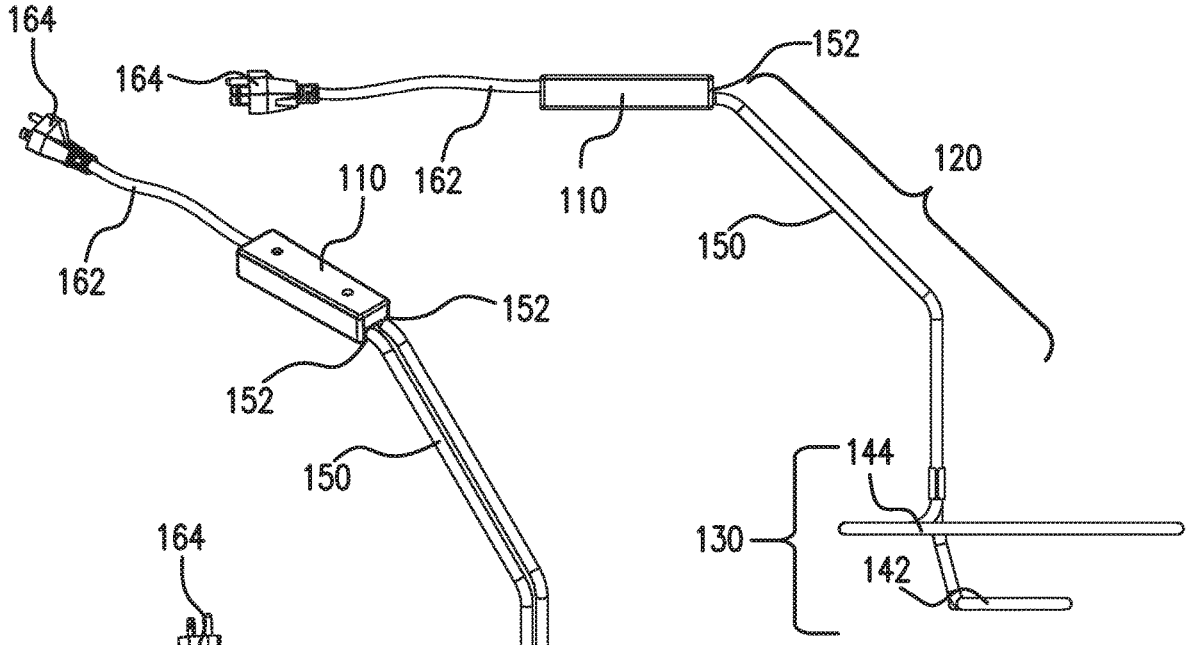
FIGS. 12A-12D show views of an electric charcoal starter according to some embodiments.
Figure 12A:
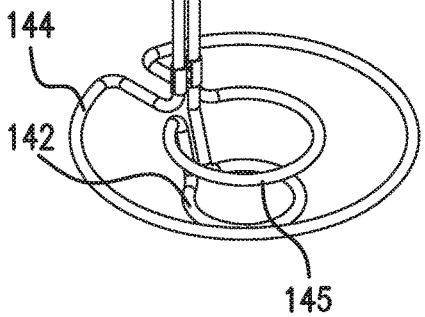
Figure 12C:
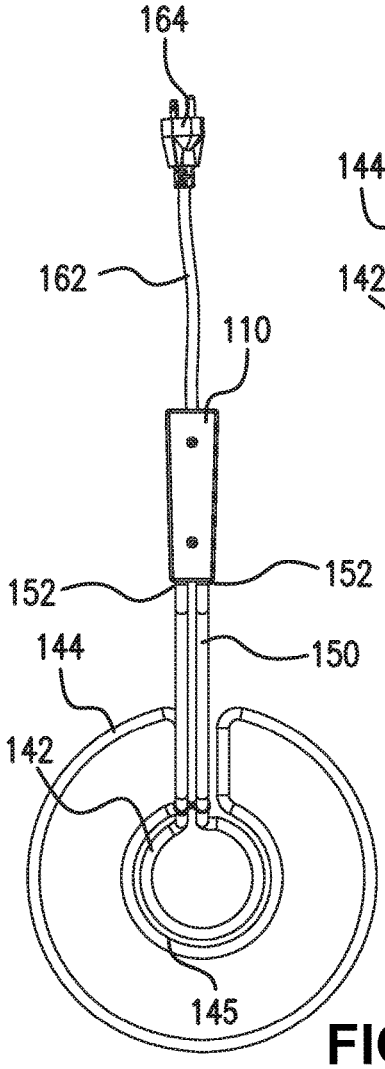
Figure 12D:
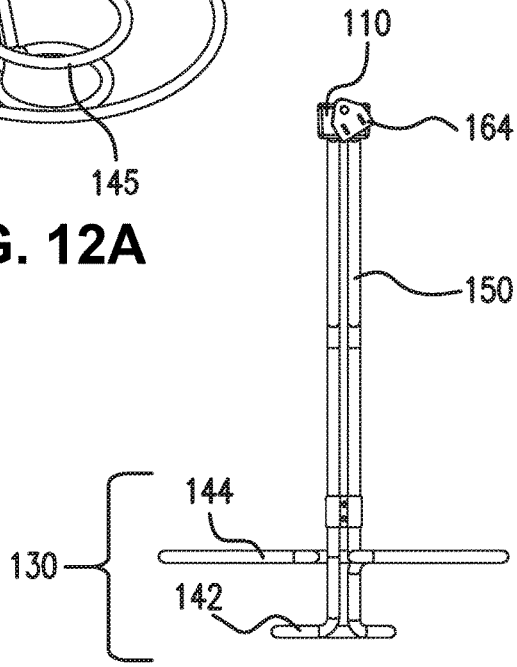

In some embodiments ignition layers 140 are continuous with the rest of ignition element 130. In some embodiments ignition layers 140 are separate and attachable to and detachable from the rest of ignition element 130 (e.g., through an electrical plug connection 134, as shown, for example, in FIG. 10). Such a modular "plug-and-play" configuration allows a user to easily customize the shape, size, position, and combination of ignition layers 140 of starter 100.

In some embodiments, to achieve the shapes and sizes described herein or other shapes and sizes within the scope of the invention, heating element 150 has two ends 152 that connect to handle 110 so that current can pass from one end 152 to the other by travelling through the balance of heating element 150, and in between these two ends heating element 150 takes the shapes described. For example, in some embodiments (see, e.g., FIGS. 1 and 6) heating element may extend from the first end 152 out from the handle until first ignition loop 142, and may bend at first ignition loop 142 to form first ignition loop 142. Heating element 150 may continue by extending from first ignition loop 142 parallel to shaft portion 132 (which may be straight) until second ignition loop 144, and may bend at second ignition loop 144 to form second ignition loop 144. Heating element 150 may continue by extending from second ignition loop 144 to the other end 152 thereof at handle 110. In some embodiments plane 22 of first ignition loop 142 forms first angle 32 of between 45 degrees and 135 degrees with respect to a first straight portion of the heating element most closely connected to the ignition loop (e.g., shaft portion 132). In some embodiments plane 24 of second ignition loop 144 forms second angle 34 of between 45 degrees and 135 degrees with respect to the first straight portion of the heating element.

Ignition loops 140 define the outline of a shape, and in this way can spread heat throughout their layer away from shaft portion 132 of ignition element 130, thereby emitting heat throughout an area away from shaft portion 132. The shape formed by ignition loops 140 can be any suitable shape, such as, for example, circular (as shown, for example, in FIGS. 3A, 11A-11D, and 12A-12D) or rectangular (as shown, for example, in FIGS. 3B and 3C). The shapes of ignition loops 142 and 144 can match (as shown, for example, in FIGS. 3A, 3B, 3C, 11A-11D, and 12A-12D). The shapes of ignition loops 142 and 144 may be aligned or concentric (as shown, for example, in FIGS. 3A, 3B, 11A-11D, and 12A-12D). The shapes of ignition loops 142 and 144 may be offset (as shown, for example, in FIG. 3C). The shapes of ignition loops 142 and 144 may be different sizes (as shown, for example, in FIGS. 3A, 3B, 11A-11D, and 12A-12D). The shapes of ignition loops 142 may be the same size. Where ignition loops 142 and 144 are different sizes, one ignition loop (e.g., ignition loop 142) may be disposed within another ignition loop (e.g., ignition loop 144) in an upper elevation view (such as in FIGS. 3A, 3B, 3C, 11A-11D, and 12A-12D).

Figure 7A:
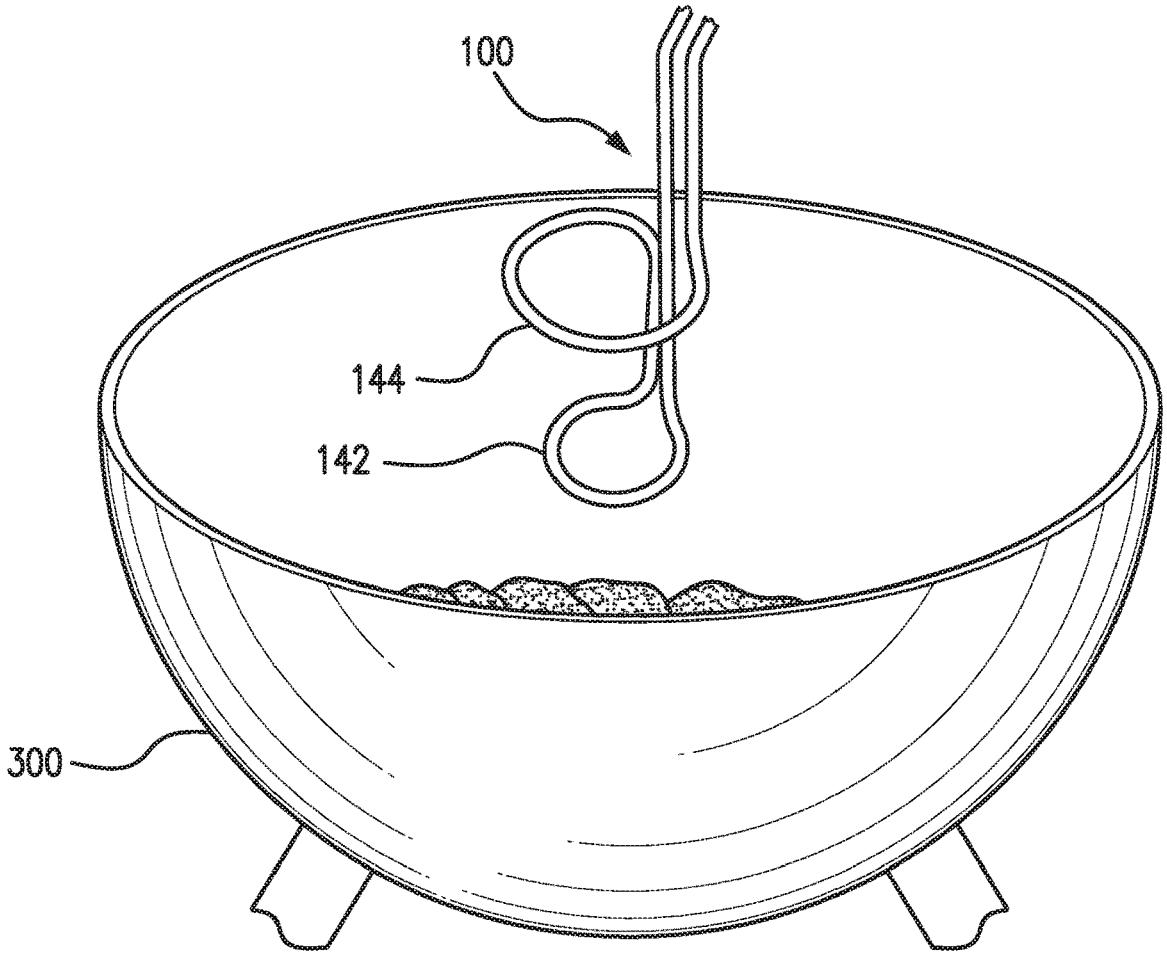
FIG. 7A shows a perspective view of an electric charcoal starter and a grill.
Figure 7B:
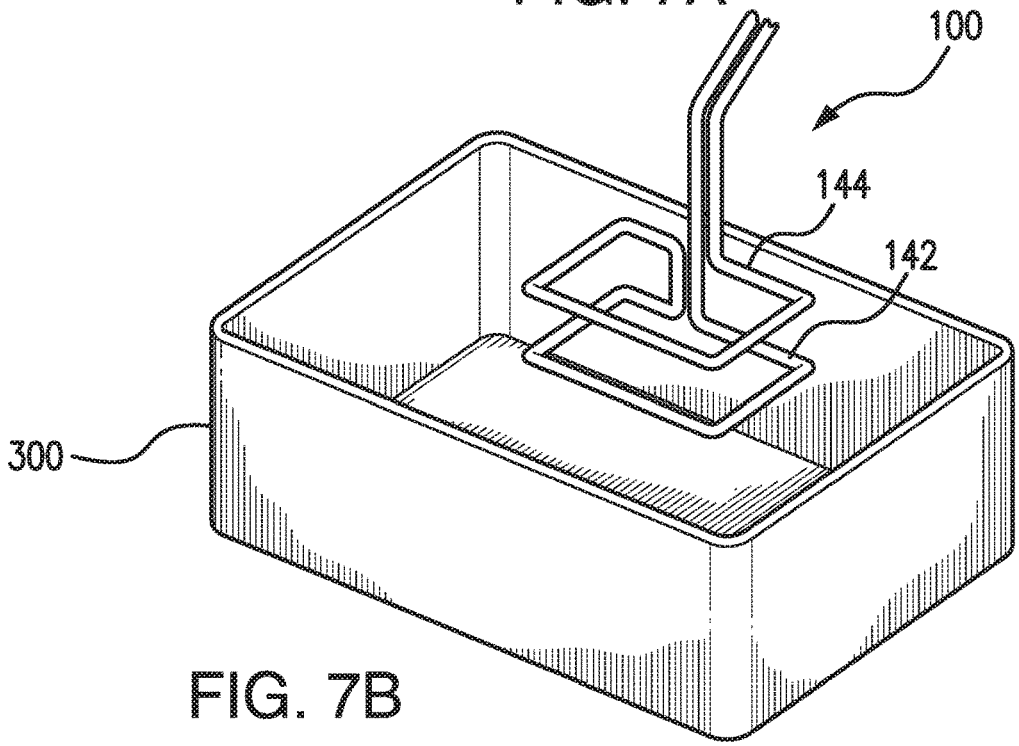
FIG. 7B shows a perspective view of an electric charcoal starter and a grill.

In some embodiments, ignition layers 140 may be shaped to correspond to a grill shape, or at least the shape of a cavity of a grill where charcoal is piled. For example, an electric charcoal starter 100 having circular-shaped ignition layers 140 may be particularly useful starting a pile 200 of charcoal in a grill 300 having a cavity with a circular cross-section, as shown, for example, in FIG. 7A, since the charcoal pile 200 may conform to the shape of the cavity. Also for example, an electric charcoal starter 100 having rectangular-shaped or elongated ignition layers 140 may be particularly useful starting a pile 200 of charcoal in a grill 300 having a cavity with a rectangular or elongated cross-section, as shown, for example, in FIG. 7B, since the charcoal pile 200 may conform to the shape of the cavity.

Also, ignition layers 140 may be sized to correspond to a grill size, or at least the size of a cavity where charcoal is piled. For example, an electric charcoal starter 100 having an upper ignition layer 144 with a larger diameter and a lower ignition layer 142 with a smaller diameter may be particularly useful starting a pile 200 of charcoal in a grill having a cavity with a smaller lower diameter than upper diameter (e.g., a cavity that tapers, as shown, for example, in FIG. 7A). This may be because the charcoal pile 200 may conform to the shape of the cavity, so ignition element 130 may be more effective in quickly igniting charcoal pile 200 if it is sized and shaped similarly.

For example, the electric charcoal starter 100 may be particularly useful for use with an egg-shaped grill, such as a Big Green Egg® grill, made by Big Green Egg®, since it has a larger circular upper ignition layer 144 corresponding to a larger-diameter upper circular section of the egg-shaped grill cavity, and a smaller circular lower ignition layer 142 corresponding to a smaller-diameter lower circular section of the egg-shaped grill cavity.

In some embodiments, heating element 150 forms lead 120, which extends between handle 110 and ignition element 130. In some embodiments handle 110 and shaft portion 132 of ignition element 130 are perpendicular to each other. In some embodiments handle 110 and shaft portion 132 of ignition element 130 are perpendicular to each other and spaced apart from each other both vertically and horizontally. In some embodiments lead 120 (or a portion thereof) may extend between handle 110 and shaft portion 132 of ignition element 130 at an oblique angle to both handle 110 and shaft portion 132. Such configuration can help keep ignition element 130 away from and below a user holding starter 100 by handle 110, as shown (e.g., in FIG. 2A lead 120 extends parallel from handle 110 a short distance, and then the next portion of lead 120 extends straight and obliquely with respect to both handle 110 and shaft portion 132 of ignition element 130, to locate ignition element 130 vertically down and horizontally away from handle 110).

In some embodiments, electric starter 100 may be configured as an igniter for wood, instead of or in addition to charcoal. For example, in some embodiments ignition layers 140 have an elongated shape, so that they extend more in a side-to-side direction than they do in a front-to-back direction, relative to electric charcoal starter 100. For example, as shown in FIG. 8, first ignition layer 142 and second ignition layer 144 each extends in a side-to-side direction 14 a greater distance than it extends in a front-to-back direction 16. In some embodiments ignition layers 140 may extend in side-to-side direction 14 at least twice the distance that they extend in front-to-back direction 16.

This elongated shape can help electric starter 100 support elongated fuel for ignition, such as logs of firewood 400, which are typically elongated. In this way electric starter 100 can ignite supported logs 400 while also supporting them, and so can also be used as a carrier to transport ignited logs 400 (e.g., by transporting electric starter 100 by its handle 110). This can give a user the ability to ignite logs 400 remote from the fire into which they are intended to be used, so that logs 400 can be pre-lit before being added to the fire. This can help to promote continuous fire production and minimize fluctuations in fire intensity due in part to putting un-lit logs onto a lit fire. In some embodiments electric starter 100 includes additional bracing elements 141 (e.g., connecting ignition layers 140) to help stabilize logs 400 being supported thereby, and/or to reinforce ignition element 130 and heating element 150 generally to help support the weight of logs 400.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The detailed description section is intended to be used to interpret the claims. The summary and abstract sections may set forth one or more but not all exemplary embodiments of the present invention as contemplated by the inventor, and thus, are not intended to limit the present invention and the appended claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. An electric charcoal starter, comprising:

a handle; and a heating element coupled to the handle, wherein the heating element comprises a plurality of ignition layers vertically spaced apart from each other, wherein the heating element is configured to be placed into a pile of charcoal in a grill basin to ignite the charcoal in the grill basin, and wherein a first ignition layer of the plurality of ignition layers has a smaller diameter than does a second ignition layer of the plurality of ignition layers, the second ignition layer being positioned above the first ignition layer.

2. The starter of claim 1, wherein the ignition layers define loops.

3. The starter of claim 1, wherein the ignition layers are electrically connected in series.

4. The starter of claim 1, wherein the heating element is continuous from the handle, through the ignition layers, and back to the handle.

5. The starter of claim 1, wherein the ignition layers are spaced apart by between 1.5 and 2.5 inches.

6. The starter of claim 1, wherein the plurality of ignition layers comprises no more and no less than two ignition layers.

7. The starter of claim 1, wherein the plurality of ignition layers comprises no more and no less than three ignition layers.

8. The starter of claim 1, wherein the heating element is metal that will heat above 650 degrees Celsius when connected to mains electricity.

9. The starter of claim 1, wherein the heating element is metal that will heat above 650 degrees Celsius when connected to a 120 volt power source.

10. An electric charcoal starter, comprising:

a handle;

an ignition element; and a lead electrically connecting the handle and the ignition element, wherein the ignition element comprises at least two ignition loops vertically spaced apart from each other, and wherein a lower of the two ignition loops has a smaller loop diameter than does an upper of the two ignition loops.

11. The starter of claim 10, wherein the ignition loops are concentric.

12. The starter of claim 10, wherein the ignition loops are circular.

13. The starter of claim 10, wherein the lead is insulated such that the lead maintains a lower surface temperature than the ignition element when current is passed through the ignition element.

14. An electric charcoal starter, comprising:

a handle;

a heating element having a first end and a second end, wherein each of the first end and the second end is connected to the handle;

wherein the heating element extends from the first end out from the handle to a first end of a first ignition loop, wherein the heating element extends from the first end of the first ignition loop to a second end of the first ignition loop to form the first ignition loop, wherein the first end of the first ignition loop is spaced apart from the second end of the first ignition loop, wherein a plane of the first ignition loop forms a first angle of between 45 degrees and 135 degrees with respect to a straight portion of the heating element most closely connected to the first ignition loop, wherein the heating element extends from the second end of the first ignition loop parallel to the straight portion to a first end of a second ignition loop, wherein the heating element extends from the first end of the second ignition loop to a second end of the second ignition loop to form the second ignition loop, wherein the first end of the second ignition loop is spaced apart from the second end of the second ignition loop, wherein a plane of the second ignition loop forms a second angle of between 45 degrees and 135 degrees with respect to the straight portion of the heating element, wherein the heating element extends from the second end of the second ignition loop to the handle, and wherein the plane of the first ignition loop is different from the plane of the second ignition loop.

15. The starter of claim 14, wherein portions of the ignition element between the second ignition loop and the handle extend in parallel.

16. The starter of claim 14, wherein the ignition loops are circular.

17. The starter of claim 14, wherein at least one of the first ignition loop and the second ignition loop comprises a pair of loops on the same plane.

18. The starter of claim 14, wherein the first ignition loop is disposed below the second ignition loop.

19. The starter of claim 14, wherein the heating element is insulated between the second ignition loop and the handle.

* * * * *